US010820084B2

(12) United States Patent
Zalisk et al.

(10) Patent No.: US 10,820,084 B2
(45) Date of Patent: Oct. 27, 2020

(54) EAR TIP SEALING STRUCTURE

(71) Applicant: BOSE CORPORATION, Framingham, MA (US)

(72) Inventors: Michael Andrew Zalisk, Arlington, MA (US); Liam Robert Kelly, Dorchester, MA (US); Thomas Aquinas Nilsen, Auburn, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/241,045

(22) Filed: Jan. 7, 2019

(65) Prior Publication Data

US 2020/0221201 A1 Jul. 9, 2020

(51) Int. Cl.
*H04R 1/10* (2006.01)
*H04R 9/06* (2006.01)

(52) U.S. Cl.
CPC ..... *H04R 1/1016* (2013.01); *H04R 1/1058* (2013.01); *H04R 9/063* (2013.01)

(58) Field of Classification Search
CPC .. H04R 1/1016; H04R 1/1066; H04R 25/652; H04R 25/656; H04R 2201/10; H04R 2225/77; H04R 2460/09
See application file for complete search history.

(56) References Cited

U.S. PATENT DOCUMENTS 3,934,100 A 1/1976 Harada
7,113,611 B2 9/2006 Leedom et al.
7,536,008 B2 5/2009 Howes et al.
D645,458 S 9/2011 Silvestri et al.
8,121,325 B2 * 2/2012 Atamaniuk ..... H04M 1/05 381/322
D655,693 S 3/2012 Silvestri et al.
8,208,676 B2 6/2012 Murozaki et al.
8,249,287 B2 8/2012 Silvestri et al.
8,254,621 B2 8/2012 Silvestri et al.
8,311,253 B2 11/2012 Silvestri et al.
(Continued)

FOREIGN PATENT DOCUMENTS

EP 3 082 347 A1 10/2016

OTHER PUBLICATIONS

International Search Report and Written Opinion for International Application No. PCT/US2020/012531 dated Jun. 26, 2020.

*Primary Examiner* — Fan S Tsang
*Assistant Examiner* — Ryan Robinson
(74) *Attorney, Agent, or Firm* — Patterson + Sheridan, LLP

(57) ABSTRACT

Aspects describe an earpiece with structure for positioning and retaining the earpiece and with structure for sealing against the entrance to the ear canal. According to aspects, the retaining structure has at least one substantially elliptical leg configured to follow the curve of the anti-helix and/or the cymba concha at the rear of the concha. The leg increases in thickness from a tip of the earpiece towards the body of the earpiece. The sealing structure is substantially frusto-conical and extends from a nozzle. The nozzle is angled to align with ear geometry. In an example, he sealing structure has a slight radius on an outer surface of the sealing structure. In another example, the sealing structure has a substantially constant thickness from the nozzle to the wide end of the sealing structure.

26 Claims, 10 Drawing Sheets

(56) References Cited

U.S. PATENT DOCUMENTS

| | | | | |
|---|---|---|---|---|
| 8,503,707 | B2 | 8/2013 | Urso et al. | |
| 8,611,969 | B2 * | 12/2013 | Smith | H04R 1/1016 455/569.1 |
| 8,737,669 | B2 | 5/2014 | Monahan et al. | |
| 8,848,964 | B2 | 9/2014 | Erdel | |
| 8,873,786 | B2 * | 10/2014 | Larsen | H04R 25/656 381/328 |
| 8,897,480 | B2 * | 11/2014 | Tan | H04R 1/105 381/380 |
| 8,929,582 | B2 | 1/2015 | Silvestri et al. | |
| 8,989,426 | B2 | 3/2015 | Silvestri et al. | |
| 9,036,852 | B2 | 5/2015 | Silvestri et al. | |
| 9,036,853 | B2 | 5/2015 | Silvestri et al. | |
| 9,042,590 | B2 | 5/2015 | Silvestri et al. | |
| 9,357,319 | B2 * | 5/2016 | Yoon | H04R 1/1041 |
| 9,398,364 | B2 | 7/2016 | Monahan et al. | |
| 9,462,366 | B2 | 10/2016 | Silvestri et al. | |
| 9,807,524 | B2 | 10/2017 | Shennib et al. | |
| 9,955,249 | B2 * | 4/2018 | Searl | H04R 1/1016 |
| 10,009,680 | B2 * | 6/2018 | Briggs | H04R 1/1058 |
| 10,034,078 | B2 | 7/2018 | Silvestri et al. | |
| 10,045,113 | B2 | 8/2018 | Silvestri et al. | |
| 10,291,980 | B2 | 5/2019 | Silvestri et al. | |
| 10,334,344 | B2 | 6/2019 | Monahan et al. | |
| 2003/0174853 | A1 * | 9/2003 | Howes | H04R 1/083 381/370 |
| 2011/0058704 | A1 | 3/2011 | Harlow et al. | |
| 2011/0268308 | A1 | 11/2011 | Vasquez | |
| 2012/0243726 | A1 * | 9/2012 | Hosoo | H04R 1/1016 381/380 |
| 2013/0163803 | A1 * | 6/2013 | Erdel | H04R 1/1091 381/373 |
| 2016/0261942 | A1 | 9/2016 | Hayden | |
| 2017/0164093 | A1 * | 6/2017 | Silvestri | H04R 1/105 |
| 2018/0184187 | A1 | 6/2018 | Silvestri et al. | |
| 2018/0242068 | A1 * | 8/2018 | Kelley | H04R 1/105 |
| 2019/0007761 | A1 * | 1/2019 | Higgins | H04R 25/60 |
| 2019/0007762 | A1 | 1/2019 | Paetsch et al. | |
| 2019/0166438 | A1 | 5/2019 | Perkins et al. | |
| 2019/0238976 | A1 | 8/2019 | Silvestri et al. | |
| 2019/0253782 | A1 | 8/2019 | Monahan et al. | |
| 2020/0014995 | A1 | 1/2020 | Monahan et al. | |

* cited by examiner

EAR TIP SEALING STRUCTURE

BACKGROUND

Aspects of the present disclosure describe various features of an in-ear tip including a structure for positioning and retaining the ear tip and a structure for sealing the ear tip against the entrance to the ear canal.

SUMMARY

Aspects describe an in-ear ear tip that is comfortable to position and wear while providing a seal between the ear tip and the wearer's ear canal. As described herein, the body of the ear tip is shaped to fit in the wearer's lower concha. The nozzle of the ear tip is angled upwards from a horizontal centerline of the ear tip body, towards the ear canal of the wearer. This helps to position an optional feedback microphone closer to the ear canal. According to aspects, the stiffness of the material in portions of the body, sealing structure, and positioning structure are selected to provide structural support for an earbud housed in the ear tip and while being comfortable for the wearer.

Aspects provide an ear tip for an in-ear earpiece. The ear tip comprises a body shaped to fit in the lower concha of a wearer's ear, a nozzle extending towards the ear canal of the wearer's ear, the nozzle including an acoustic passage to conduct sound waves to the ear canal of the wearer, a substantially frusto-conical sealing structure extending from the nozzle, wherein a narrow end of the sealing structure is joined to the nozzle and a wide end of the sealing structure is larger than a typical ear canal is wide, and a retaining structure extending from the body towards the antihelix of the wearer's ear, wherein the retaining structure comprises a first leg that tapers in thickness from the body to the tip.

In an aspect, the retaining structure comprises a second leg having a first end attached to the first leg at an attachment end to form a tip and a second end attached to the body, wherein the second leg tapers in thickness from the body to the tip.

In an aspect, the body comprises an inner body and an outer body. The material of the inner body has a first hardness, a material of the outer body, the first leg, and the second leg has a second hardness, and a material of the frusto-conical sealing structure has a third hardness, and the first hardness is greater than the second hardness, and the second hardness is greater than the third hardness.

In an aspect, the frusto-conical sealing structure comprises a substantially straight edge on the interior portion of the frusto-conical sealing structure proximate to the nozzle, and a curvature on the exterior portion of the frusto-conical sealing structure. In an aspect, the exterior portion contacts flesh of the wearer's ear when the ear tip is positioned in the wearer's ear.

In an aspect, the body comprises an inner body and an outer body and a material of the outer body is disposed over a material of the inner body. In an aspect, the material of the inner body has a first hardness, the material of the outer body has a second hardness, and a material of the frusto-conical sealing structure has a third hardness, and the first hardness is greater than the second hardness, and the second hardness is greater than the third hardness. In an aspect, a material of the retaining structure has the second hardness.

In an aspect, the body comprises a substantially elliptical shape. In an aspect, the first leg and the second leg each have an elliptical cross-section. In an aspect, the nozzle extends towards the ear canal at an upward angle relative to a horizontal centerline of the body. In an aspect, the nozzle extends from the body towards the ear canal at an angle to fit into the ear canal.

In an aspect, the nozzle comprises a distal end, and at least a portion of the distal end of the nozzle comprises a non-planar surface. In an aspect, the non-planar surface comprises a series of peaks and valleys. In an aspect, the non-planar surface is closer to the inner ear of the wearer than the body of the ear tip when the ear tip is positioned in the wearer's ear.

In an aspect, the body includes a cut-out configured to house a pressure equalization (PEQ) port.

In an aspect, the frusto-conical sealing structure has a substantially constant thickness from the nozzle to the wide end of the sealing structure.

Aspects provide an ear tip for an in-ear earpiece. The ear tip comprises a substantially elliptical body shaped to fit in the lower concha of a wearer's ear, a nozzle extending towards the ear canal of the wearer's ear at an upward angle relative to a horizontal centerline of the body, the nozzle including an acoustic passage to conduct sound waves to the ear canal of the wearer, a substantially frusto-conical sealing structure extending from the nozzle, wherein a narrow end of the sealing structure is joined to the nozzle and a wide end of the sealing structure is larger than a typical ear canal is wide, and a retaining structure extending from the body towards the antihelix of the wearer's ear, wherein the retaining structure comprises a first leg.

In an aspect, the first leg tapers from the body to the tip.

In an aspect, the retaining structure comprises a second leg having a first end attached to the first leg at an attachment end to form a tip and a second end attached to the body, wherein the second leg tapers in thickness from the body to the tip. In an aspect, the length of the first leg is substantially equal to the length of the second leg.

In an aspect, an end of the nozzle located closest to the inner ear of the wearer when the ear tip is positioned in the wearer's ear comprises a non-planar surface. In an aspect, the non-planar surface comprises a series of peaks having substantially equal heights and a series of valleys having substantially equal heights.

In an aspect, the body comprises an inner body and an outer body and a material of the outer body is disposed over a material of the inner body. In an aspect, the material of the inner body is harder than the material of the outer body. In an aspect, the material of the outer body is harder than a material of the frusto-conical sealing structure.

In an aspect, the body includes a cut-out configured to house a pressure equalization (PEQ) port.

In an aspect, the frusto-conical sealing structure has a substantially constant thickness from the nozzle to the wide end of the sealing structure.

All examples and features mentioned herein can be combined in any technically possible manner.

Other features, objects, and advantages will become apparent from the following detailed description, when read in connection with the following drawing.

DETAILED DESCRIPTION

The ear tip described herein provides orientation, stability, and sealing to the entrance of the ear canal and to the ear structure outside the ear canal, without excessive radial pressure, and without inward clamping pressure provided by a source not included in the earpiece. Aspects describe an in-ear earpiece that is designed to fit in the right ear. An earpiece includes an ear tip. An ear tip may be referred to as a cushion that houses an earbud. An earpiece that is designed to fit in the left ear is a mirror image of the earpiece described below, and operates according to the same principles, and is not described herein.

Figure 1A:
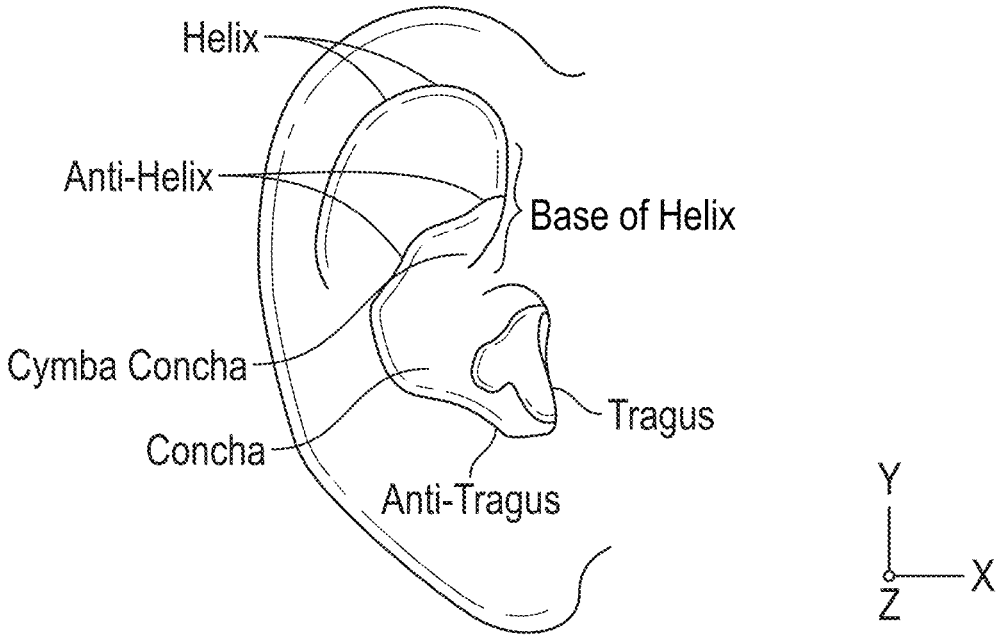
FIG. 1A is a view of the lateral surface of the human ear.
Figure 1B:
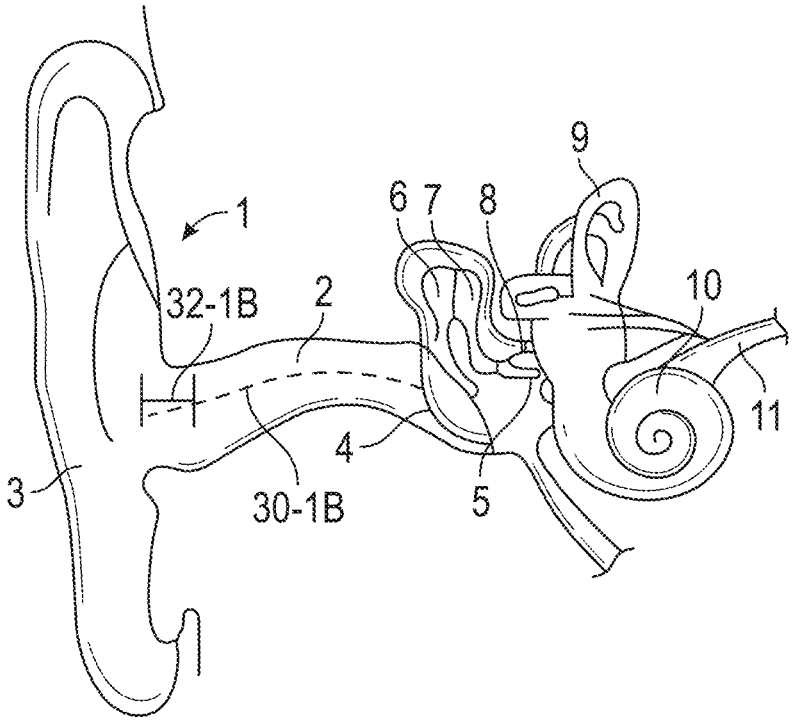
FIGS. 1B and 1C are exemplary cross-sections of the human ear.
Figure 1C:
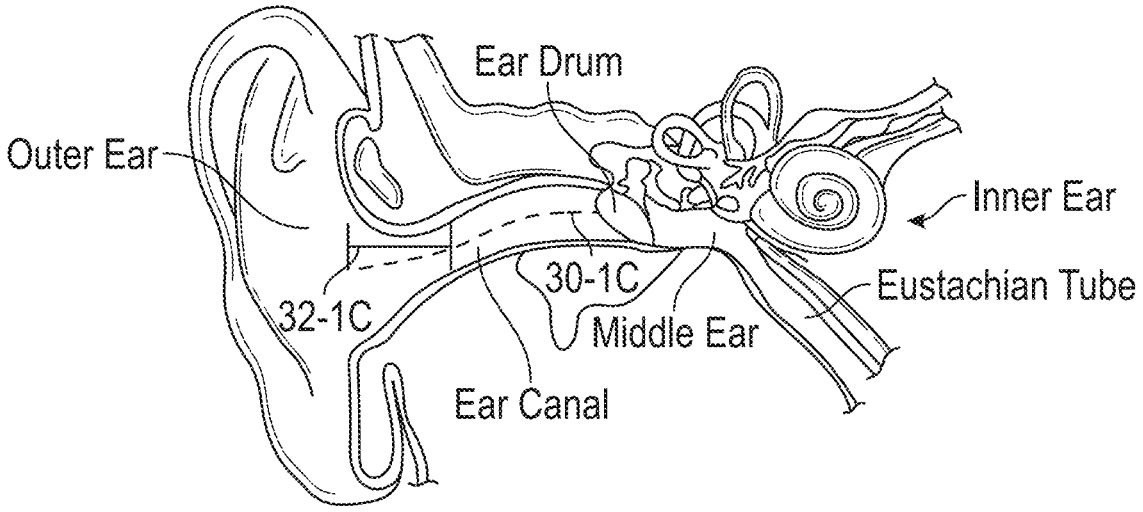

FIG. 1A shows the lateral surface of a human right ear, with some features identified. There are many different ear sizes and geometries. Some ears have additional features that are not shown in FIG. 1A. Some ears lack some of the features that are shown in FIG. 1A. Some features may be more or less prominent than are shown in FIG. 1A. FIGS. 1B and 1C show two exemplary cross-sections of the human ear, with some features identified. The ear canal is an irregularly shaped cylinder with a variable cross sectional area and a centerline that is not straight. Among the features identified is the entrance to the ear canal and the main portion of the ear canal. In this specification, the entrance to the ear canal refers to the portion of the ear canal near the concha where the walls of the ear canal are substantially non-parallel to the centerline of the ear canal. The precise structure of the human ear varies widely from individual to individual. For example, in the cross section of FIG. 1B, there is a relatively sharp transition from ear canal walls that are non-parallel to a centerline 30-1B of the ear canal to walls that are substantially parallel to a centerline of the ear canal, so the entrance 32-1B to the ear canal is relatively short. In the cross-section of FIG. 1C, there is a more gradual transition from walls that are non-parallel to a centerline of the ear canal to walls that are substantially parallel to a centerline 30-1C of the ear canal, so the entrance 32-1C to the ear canal is relatively long.

Figure 2A:
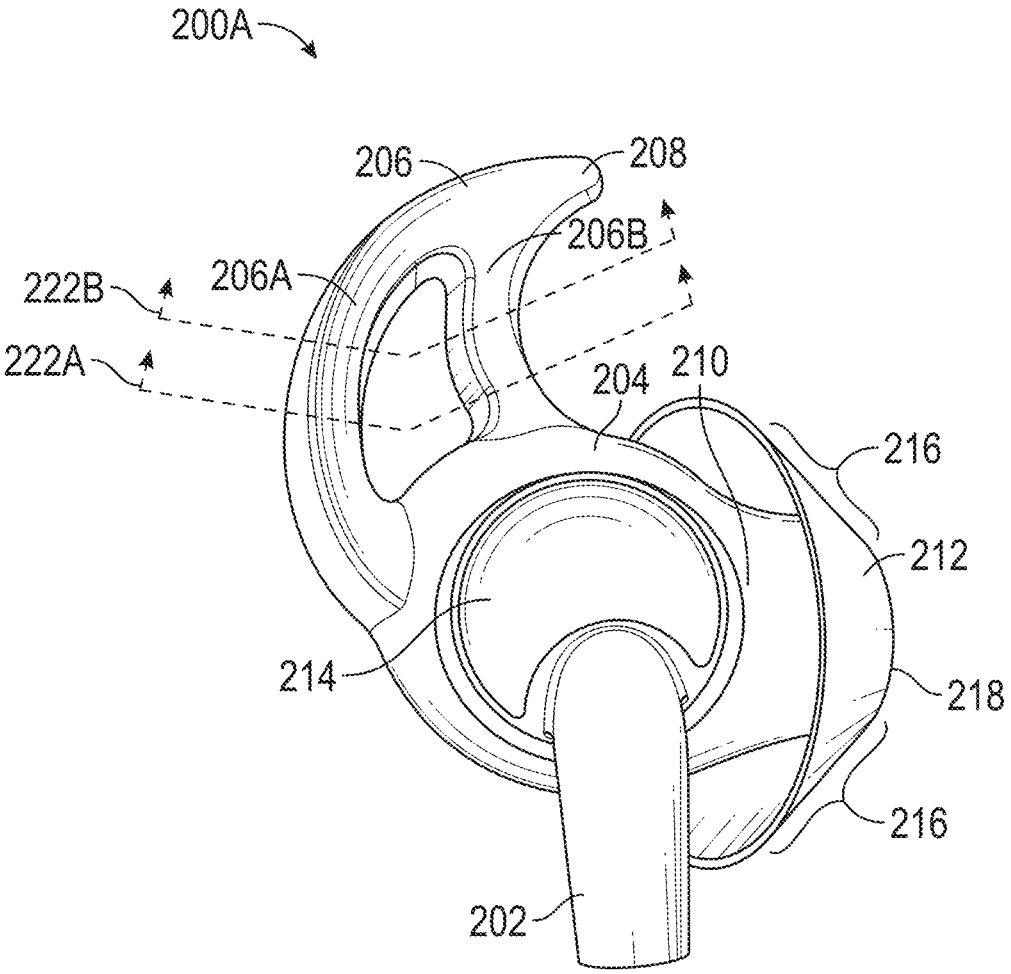
FIG. 2A is a front view of an ear tip including an earbud.

FIG. 2A is a front view of an earpiece 200A. The earpiece includes an ear tip or cushion that houses an earbud. In examples, the ear tip includes three portions: a body 204, a substantially frusto-conical sealing structure 212, and a positioning and retaining structure 206. The earpiece 200A may optionally include a stem 202 for positioning cabling and the like, a body 204 that houses an acoustic driver module, a nozzle 210 extending from the body 204 towards a substantially frusto-conical sealing structure 212, and a positioning and retaining structure 206. Some earpieces may lack the stem 202 but may include electronics modules (not shown) for wirelessly communicating with external devices. Other earpieces may lack the stem and the acoustic driver module and may function as passive earplugs.

Figure 2B:
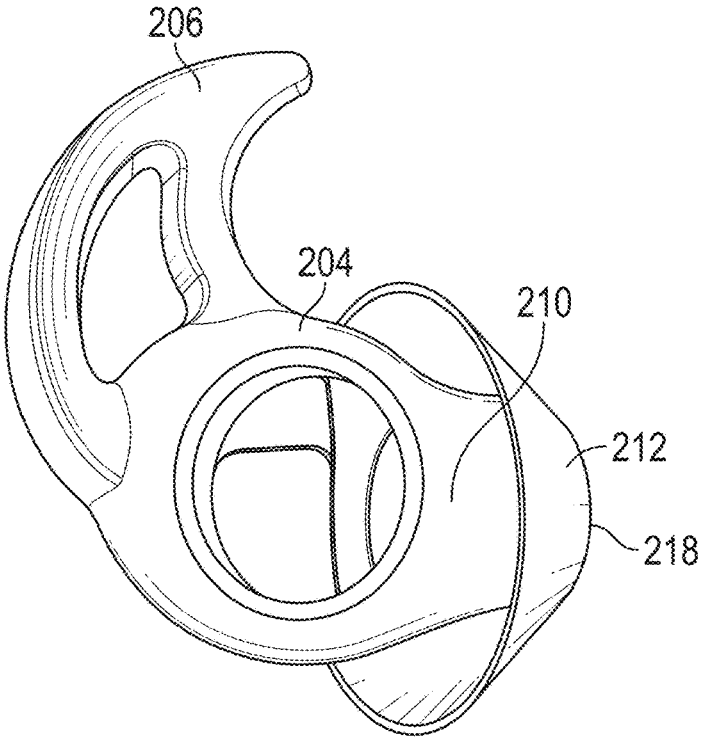
FIG. 2B is a rear view of an ear tip.
Figure 2C:
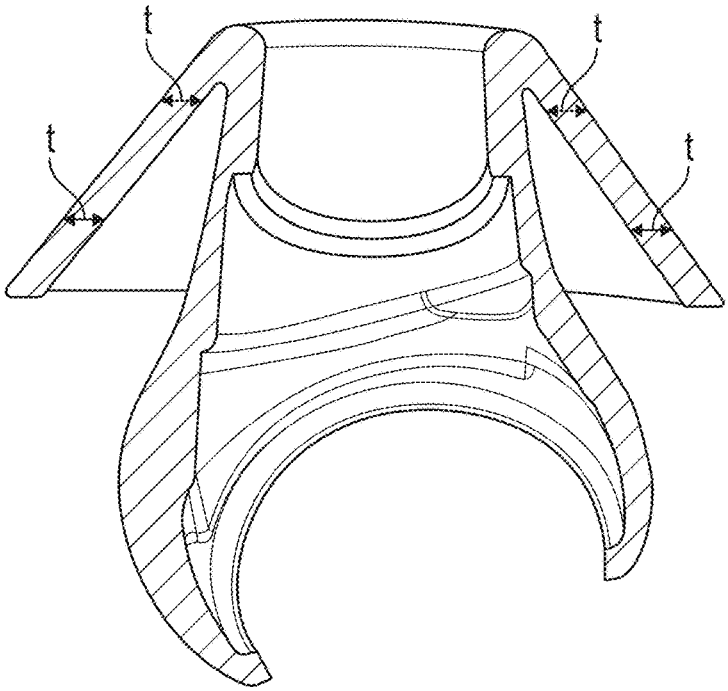
FIG. 2C illustrates an example cross-section of an ear tip.
Figure 2D:
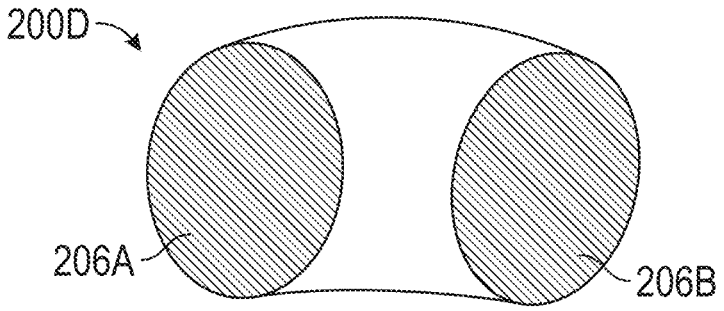
FIG. 2D illustrates an example cross-section of a positioning and retaining structure.
Figure 3:
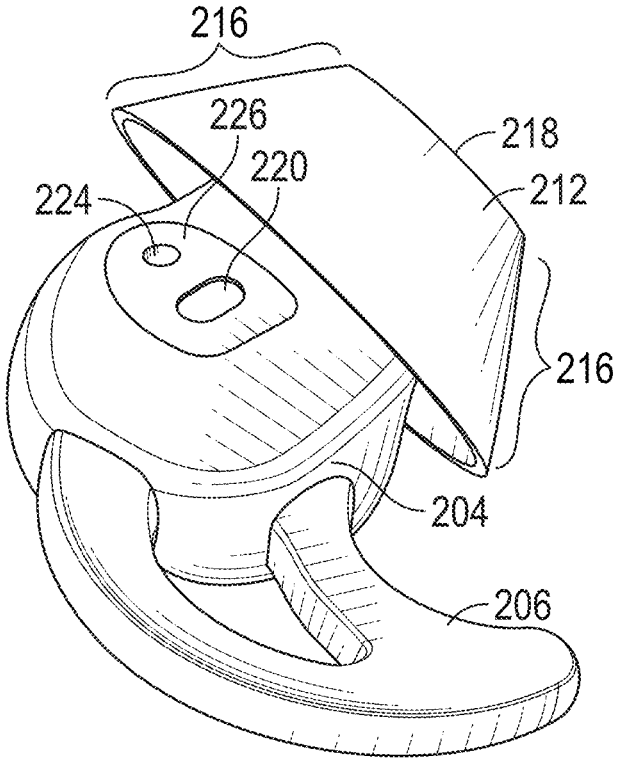
FIG. 3 is a rear view of an ear tip including a sensor lens and a pressure equalization (PEQ) port.
Figure 4:
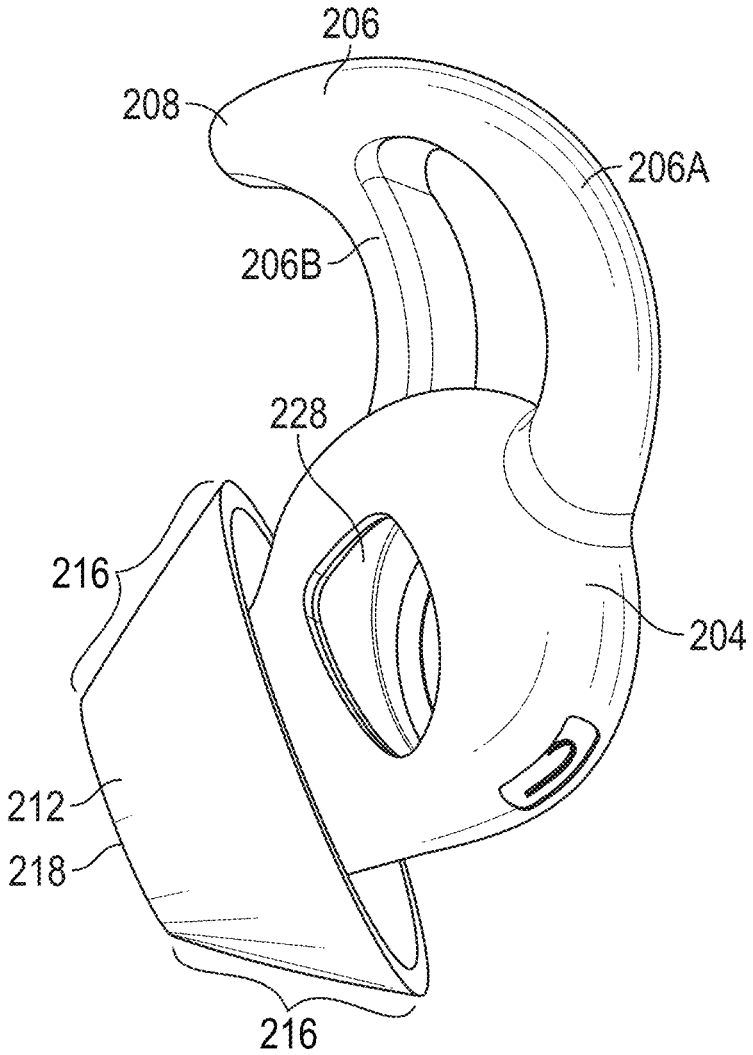
FIG. 4 is a rear view of an earpiece including an opening for a component that includes the sensor lens and PEQ port.
Figure 5A:
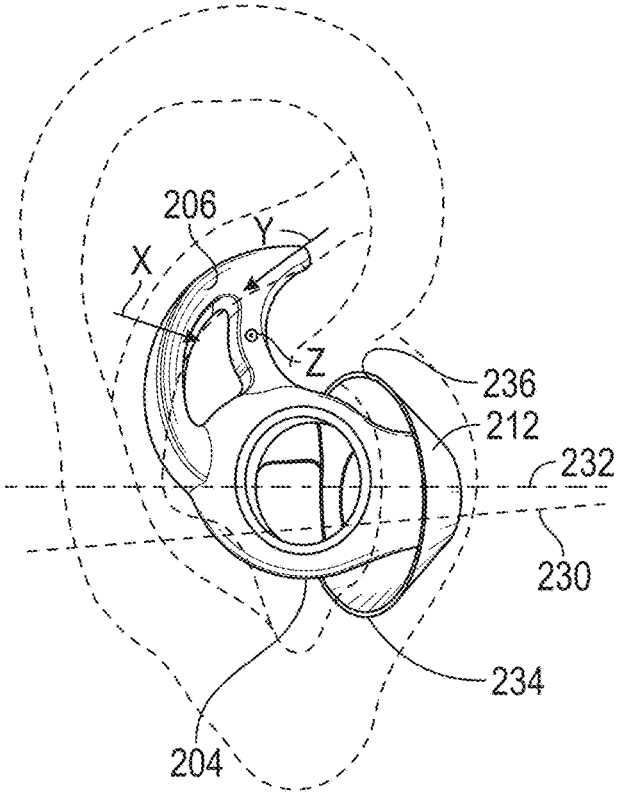
FIG. 5A is an example of an ear tip positioned in a wearer's ear.
Figure 5B:
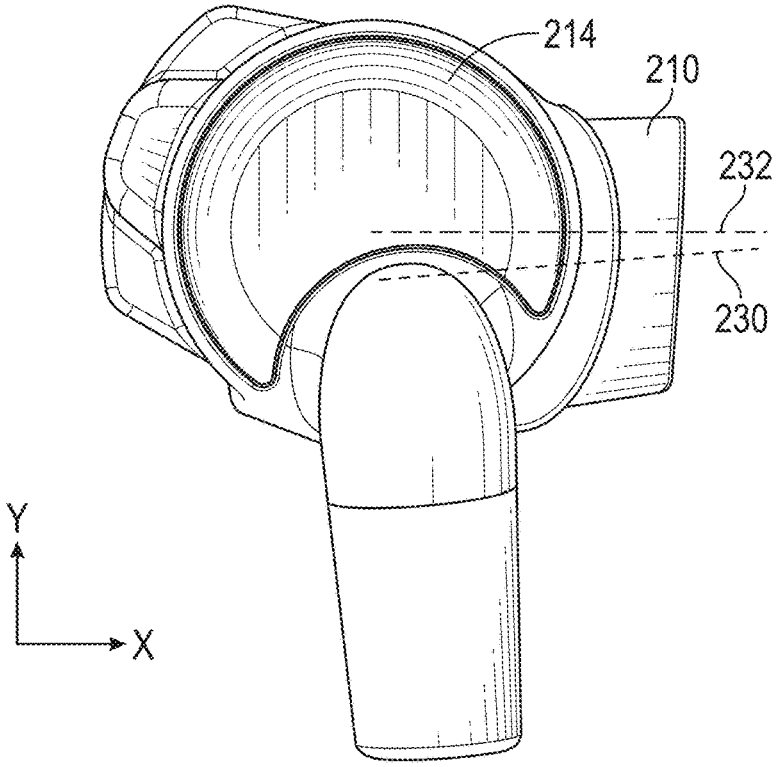
FIG. 5B illustrates an example of a portion of an earbud and nozzle that is not positioned in a wearer's ear.
Figure 5C:
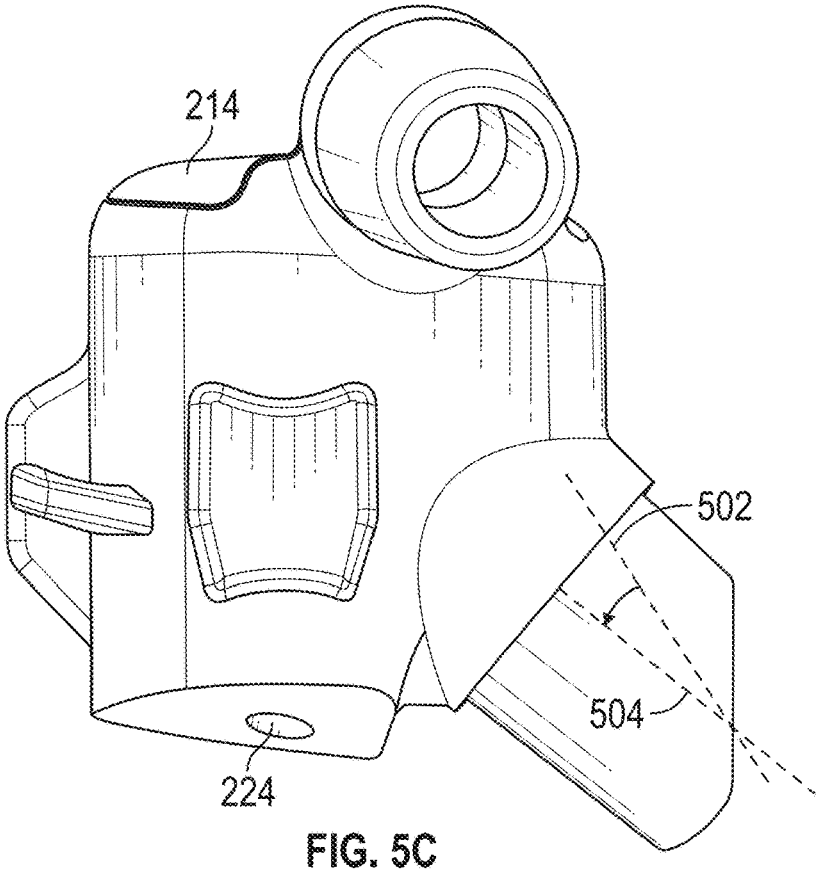
FIG. 5C illustrates a side view of a portion of an earbud and nozzle outside of the wearer's ear.
Figure 5D:
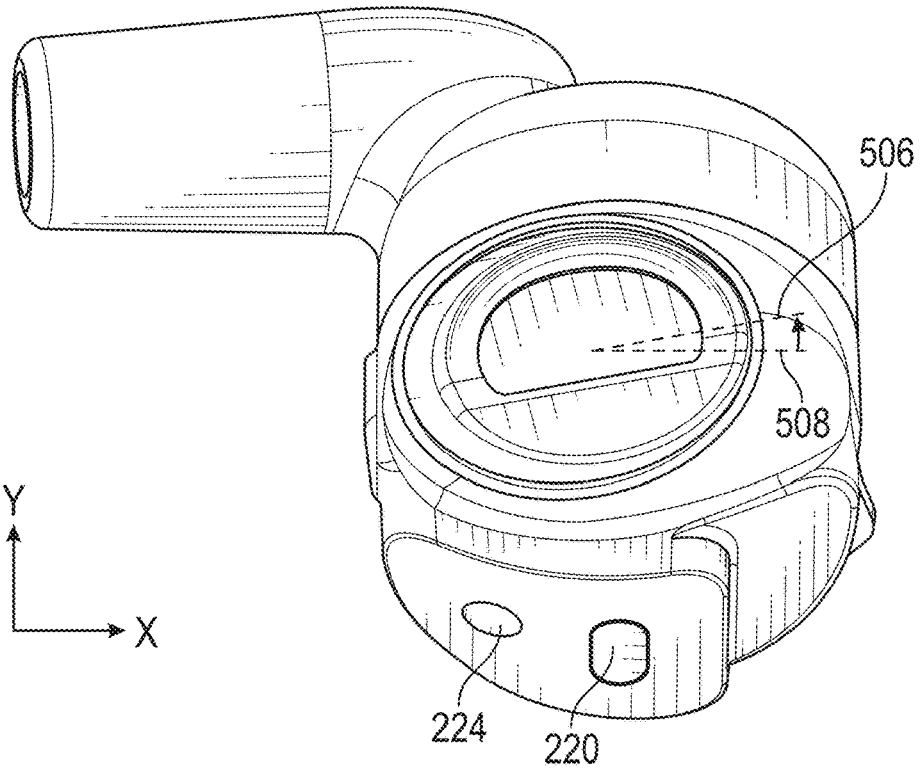
FIG. 5D illustrates an example of portions of an earpiece.
Figure 6:
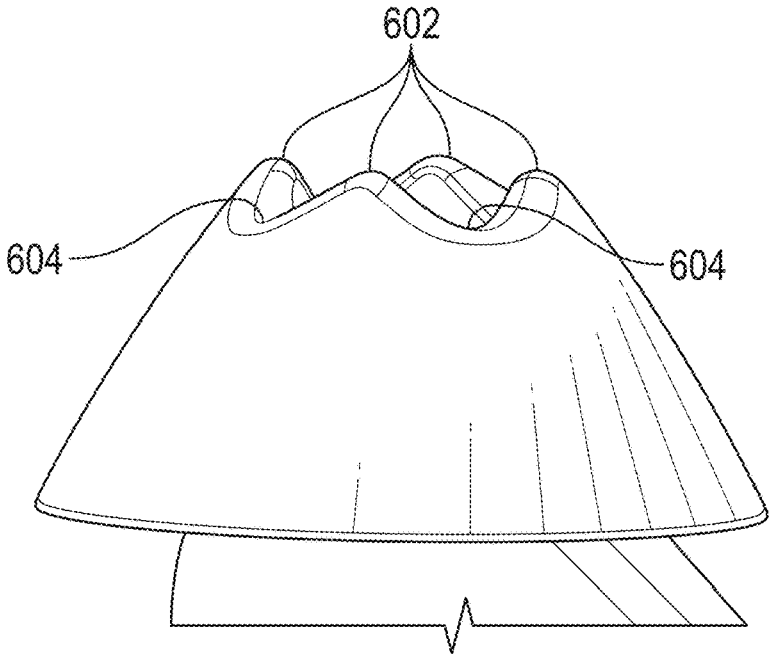
FIG. 6 is a side view of a nozzle having a non-planar distal end.
Figure 7:
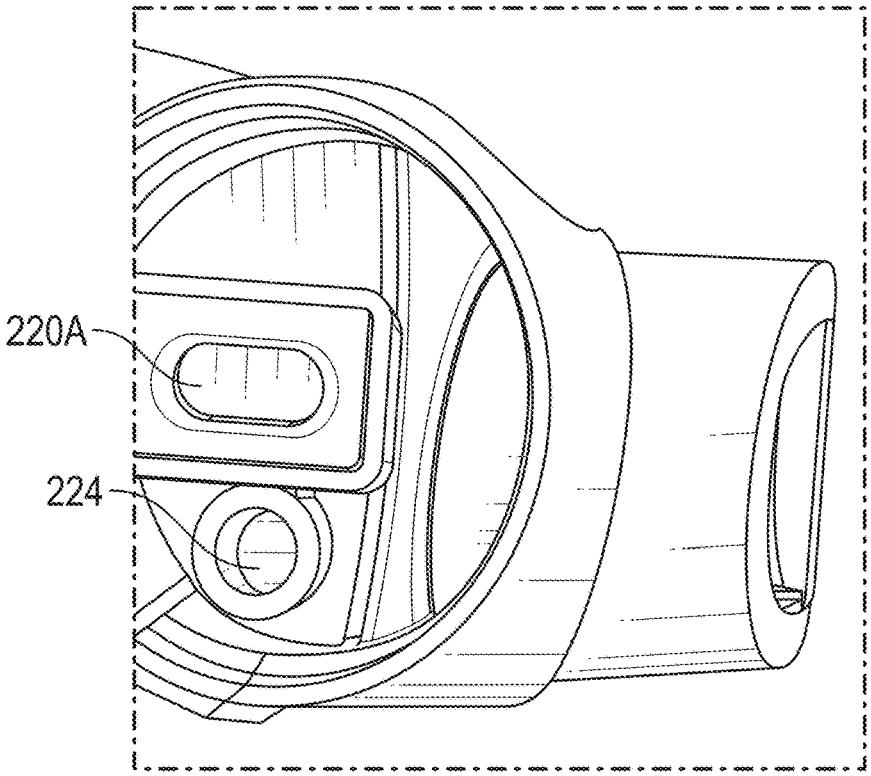
FIG. 7 illustrates a rear chamber of an earbud.
Figure 8:
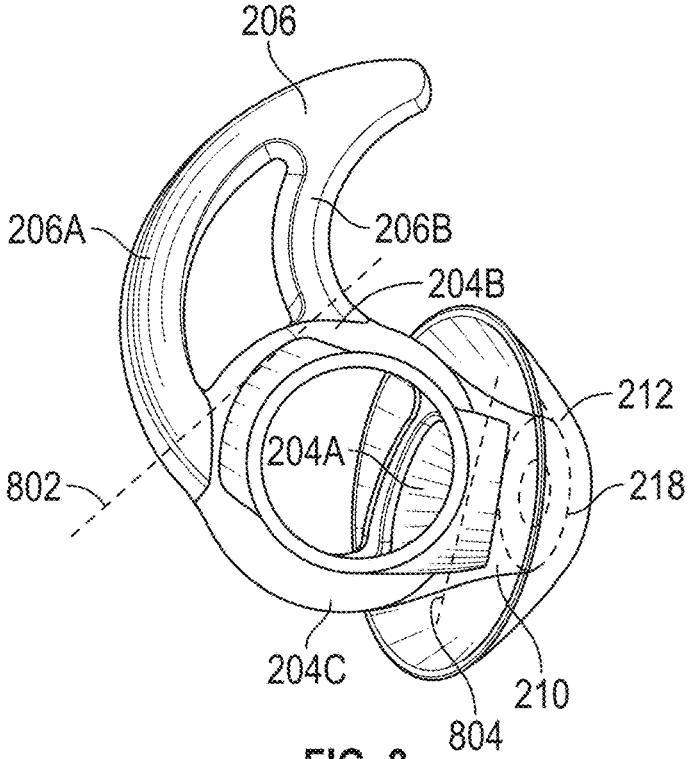
FIG. 8 illustrates an example of an ear tip made of a triple durometer material.
Figure 9A:
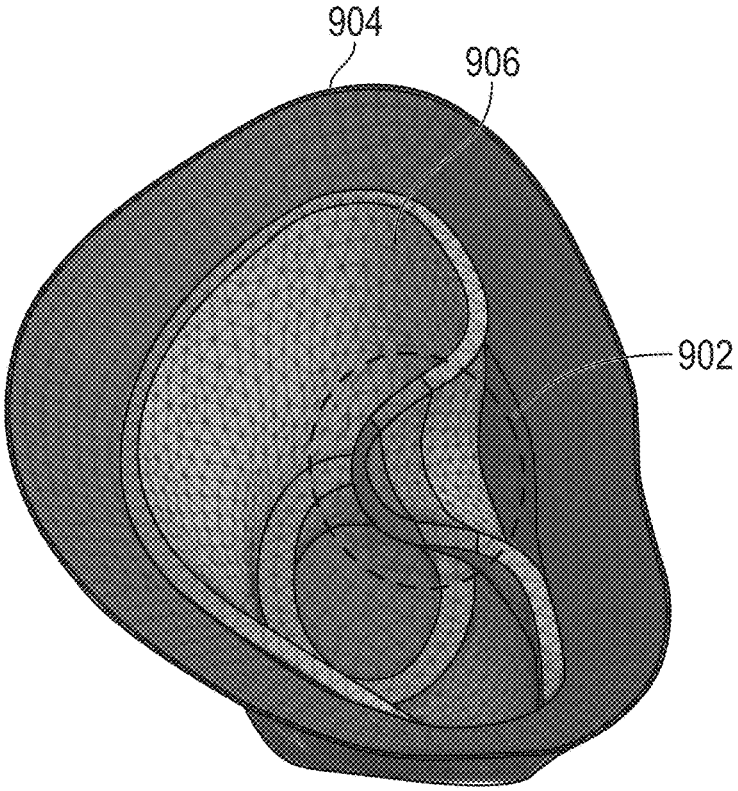
FIG. 9A illustrates an image of an example of buckling in an ear tip having a tapered sealing structure.
Figure 9B:
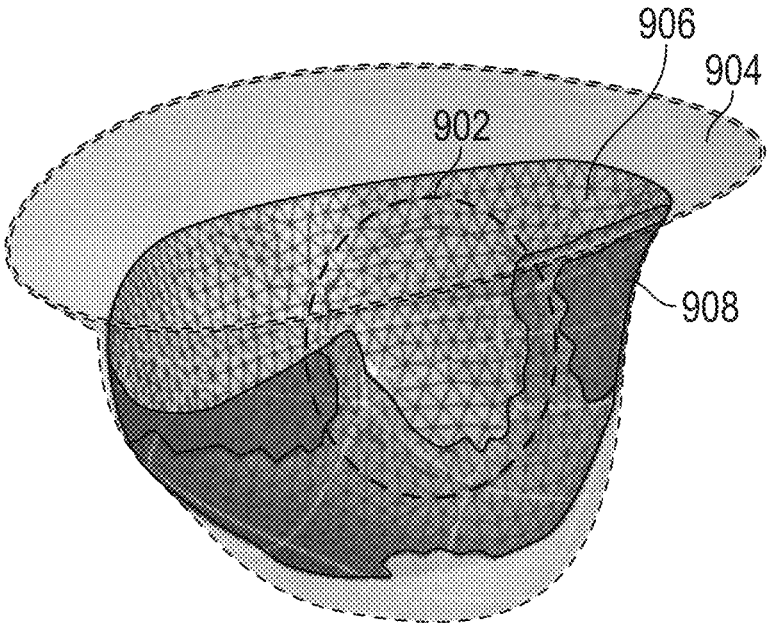
FIG. 9B illustrates an image of an example of how buckling affects the seal between the ear tip and the wearer's ear.
Figure 10:
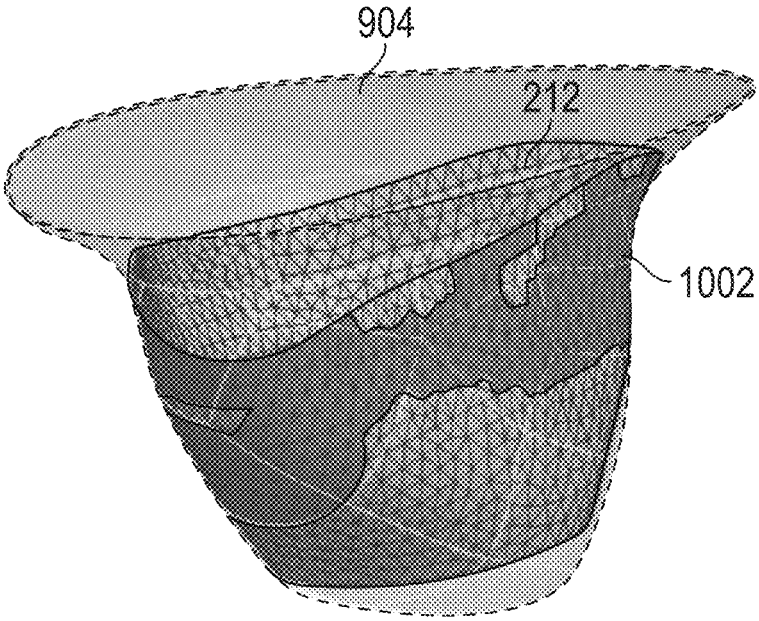
FIG. 10 illustrates an image of an example of a seal between the circumference of the ear tip and the wearer's ear.

FIG. 2B illustrates a front view of an earpiece without an earbud 214. FIG. 2C illustrates an example cross-section of an ear tip. FIG. 2D illustrates an example cross-section of an example positioning and retaining structure. FIG. 3 is a rear view of an earpiece, including a sensor lens 220 and PEQ port 224, and not including an earbud 214 and stem 202. FIG. 4 is a rear view of an earpiece not including the earbud 214, stem 202, and sensor lens 220. FIG. 5A illustrates an example ear tip positioned in a wearer's ear. FIG. 5B illustrates an example of a portion of an earbud and nozzle outside of a wearer's ear. FIG. 5C illustrates a side view of a portion of an earbud and nozzle outside of the wearer's ear. FIG. 5D illustrates an example of portions of an earpiece. FIG. 6 illustrates an example of a nozzle having a non-planar distal end. FIG. 7 illustrates an example of a portion of a rear chamber of an earbud. FIG. 8 illustrates an example of a triple durometer ear tip that does not include an earbud. FIG. 9A illustrates an example of buckling in an ear tip having a tapered sealing structure. FIG. 9B illustrates an example of how buckling affects the seal between the ear tip and the wearer's ear. FIG. 10 illustrates an example of a seal formed between the circumference of the ear tip and the wearer's ear canal when the ear tip has a substantially constant thickness from the nozzle extending down the tip. Some elements may not be marked or visible in every figure. For sake of consistency, similar reference numerals are used throughout FIGS. 2A-10. The features illustrated in FIGS. 2A-10 may be combined in a single earpiece in any technically feasible manner.

The earpiece 200A may include a stem 202 for positioning cabling and the like, a body 204 that houses an acoustic driver module, a nozzle 210 extending from the body 204 towards a substantially frusto-conical sealing structure 212, and a positioning and retaining structure.

The body 204 of the ear tip is substantially elliptical in shape. A substantially elliptical shape is suited to align with typical ear geometries. The shape of the body 204 is configured to match the lower concha of a wearer's ear as illustrated in FIG. 5A.

In an example, the body 204 houses an earbud 214 including an acoustic driver module. The earbud 214 may include a stem 202 for positioning cabling and the like; however, some earbuds, and therefore earpieces, may lack the stem 202 and may include electronic modules (not shown) for wirelessly communicating with external devices. Other earpieces may lack the stem and the acoustic driver module and may function as passive earplugs.

In an example, one or more snaps or protrusions are formed on an external portion of an earbud housing. In an aspect, the snaps are referred to as retention ribs. The body 204 stretches around the earbud housing. The body has mating features that correspond to the snaps. The snaps or protrusions help to hold the body 204 around the earbud. In addition, the snaps and mating features help prevent the earbud from falling from the body without intention. In an example, a first snap extends long a first portion of the earbud housing and a second snap extends around a second portion of the earbud housing. The snaps help to hold the stretched body in place, around the housing. In an example, an interior surface of the body has indentations configured to receive the snaps to further help the body stay positioned over the earbud housing.

A nozzle 210 extends from the body 204 towards the ear canal of the wearer's ear. The nozzle includes an acoustic passage to conduct sound waves to the ear canal of the wearer. FIG. 5A illustrates an ear tip positioned in a wearer's ear. FIG. 5B illustrates a portion of an earbud and nozzle outside of the wearer's ear. As illustrated in FIG. 5B, the horizontal centerline 230 of the nozzle is offset from the horizontal centerline of the body 232. By angling the nozzle upward from the horizontal centerline of the body 232, the nozzle is tilted to align with typical ear geometry. According to aspects, the horizontal centerline of the nozzle 230 is offset from the horizontal centerline of the body 232 by approximately 5 degrees. According to aspects, the nozzle houses a feedback microphone, which may be used to perform feedback active noise reduction (ANR). The tilt of the nozzle, relative to the body, positions the feedback microphone closer to the eardrum.

FIG. 5C illustrates a side view of a portion of an earbud and nozzle outside of the wearer's ear. In some earpieces, the nozzle is angled from the earbud along a nozzle centerline 502. According to aspects, in the earpiece described herein, the nozzle 210 is angled downward as shown along the nozzle centerline 504, so the earpiece sits more deeply into the concha of the wearer's ear than it would where the nozzle angled along the nozzle centerline 502. In aspects, the nozzle is angled downward having a centerline as shown at 504 in combination with the nozzle being offset from the horizontal centerline of the body, as shown in FIGS. 5A and 5B.

FIG. 5D illustrates an example of portions of an earpiece. According to aspects, in addition to the horizontal centerline 230 of the nozzle being offset from the horizontal centerline of the body (as shown in FIGS. 5A and 5B) and the nozzle being angled as shown in FIG. 5C, an elliptical opening for the nozzle is not parallel with the X-axis as shown at 506. This results in slight rotation of the sealing structure 212 to create a good seal with a typical wearer's ear canal.

In an example, a distal end of the nozzle 210 includes a planar surface 218. A planar surface at the distal end of the nozzle is illustrated, for example, in FIGS. 2A and 8. In other examples, and as shown in FIG. 6, at least a portion of the distal end of the nozzle includes a non-planar surface. In certain scenarios, it is undesirable for the distal end of the nozzle to be sealed off or substantially sealed off from air flow. As an example, under certain conditions when an ear tip is placed in the wearer's ear, the distal end of the nozzle may become substantially sealed because it contacts the wearer's ear canal as the wearer is positioning the ear tip in the wearer's ear. In an earbud that provides active noise cancellation, acoustic circuitry (housed in the earbud, for example) may output a signal to offset the sounds received from a feedback microphone. When the end of the nozzle becomes blocked, or substantially sealed, as it may during positioning of the earbud in the wearer's ear, an undesirable high-pitched noise or squeal may be outputted, which creates an undesirable experience for the wearer. According to an example, a non-planar surface includes at a series of peaks 602 and a series of valleys 604 around the distal end of the nozzle. The peaks 602 may each extend to a same or substantially similar height from the end of the nozzle. The valleys 604 may have a same or substantially similar height relative to the peaks 602. A non-planar design, such as the example illustrated in FIG. 6, make it more unlikely that the end of the nozzle may be sealed off or substantially sealed off from air flow, e.g., during positioning of the earbud in the wearer's ear.

A narrow end of the substantially frusto-conical sealing structure 212 occurs at a distal end of the nozzle 210. The wider end of the frusto-conical sealing structure 212 is larger than a typical ear canal is wide. The frusto-conical sealing structure 212 has a straight or substantially straight edge on an interior portion proximate to the nozzle 210. In aspects, the frusto-conical sealing structure 212 has a curvature on an exterior portion 216 of the sealing structure 212. In an example, the curvature is approximately a 40 mm radius. The exterior portion 216 of the sealing structure 212 contacts the flesh of the wearer's ear when the ear tip is positioned in the wearer's ear.

FIG. 2C illustrates a cross-section of an ear tip, in accordance with certain aspects. As illustrated in FIG. 2C, in aspects, the frusto-conical sealing structure 212 has a substantially constant thickness t from the nozzle extending outwards, when the ear tip is positioned in a wearer's ear. In aspects, the constant or substantially constant thickness t is approximately 1.1 mm. A sealing structure having a constant or substantially constant thickness provides consistency in sealing from user to user.

Some sealing structures taper in thickness from the nozzle extending outwards when the ear tip is positioned in a wearer's ear. For some users, this tapering leads to buckling or part of the sealing structure folding over itself. FIG. 9A illustrates an example of a tapered sealing structure 906 in an ear canal 904 of a wearer. The sealing structure 906 experiences compressions from the user's ear 904 when positioned in-ear. As a result, the sealing structure 906 buckles, as shown at 902, when positioned in the ear 904. The buckling does not allow a seal to form between the circumference of the sealing structure 906 and the ear canal. In FIG. 9B, the sealing structure 906 is positioned in the wearer's ear 904. 908 illustrates portions of the sealing structure 906 that may contact and create a seal with the wearer's ear 904. As shown in FIG. 9B, a seal is not formed around the circumference of the sealing structure. The lack of seal creates a leak path of the sealing structure where the sealing structure folds over itself at 902.

The leak path negatively affects the user's perception of ANR performed by the earpiece. In an example earpiece that performs ANR, the speaker plays a sound that travels through both the nozzle and the leak path. The desired sound traveling through the leak path is fed to a feedforward microphone, and an unwanted feedback loop is created around the sound that traveled from the speaker to the leak path. This is especially undesirable for hearing assistance headphones. In certain scenarios, the leak path results in poor bass performance.

Unlike some tapered sealing structure designs, where the sealing structure tapers in thickness from the nozzle extending outwards, a sealing structure having a constant thickness creates a better seal with the ear canal of a wearer's ear. FIG. 10 illustrates an untapered sealing structure 212 positioned in a wearer's ear 904. 1002 illustrates portions of the sealing structure 212 that contact and create a seal with the wearer's ear 904. A seal formed around the circumference of the sealing structure 212 with the wearer's ear 904 improves ANR performance by canceling out undesired noises, improves bass performance, and provides increased consistency in sealing from user to user. The frusto-conical sealing structure 212 is asymmetric. Referring to FIG. 5A, when positioned in a wearer's ear, the angle between the centerline of the nozzle 230 to the lowest 234, bottom portion of the frusto-conical sealing structure 212 is larger than the angle between the centerline of the nozzle 230 to the highest 236, top portion of the frusto-conical sealing structure 212. The larger angle allows more surface area on the bottom part of the frusto-conical sealing structure 212 to create a better seal along the anti-tragus of a wearer's ear.

The length of the frusto-conical sealing structure 212 between the highest point 236 and lowest point 234 ranges between approximately 17 mm to approximately 21 mm. A sealing structure within these dimensions fits into the ear canal of many users to comfortably enter and seal the entrance of the ear canal. Smaller or larger versions may be used for users with below- or above-averaged-sized ear, including children. Versions with similar overall size but different aspect ratios may be provided for users with ear canal entrances that are more- or less-circular than average.

The positioning and retaining structure 206 holds the earpiece in position in a wearer's ear, without significant contribution from the portions of the ear tip that engage the ear canal and without any structure external to the ear tip.

In an example, the ear tip includes a positioning and retaining structure 206 having an outer leg 206A and an inner leg 206B. A first end of the outer leg 206A is attached to a first end of the inner leg 206B and form a point 208. A second end of the outer leg 206A and a second end of the inner leg 206B are separately attached to the body 204. The outer leg 206A is curved to generally follow the curve of the anti-helix and/or the cymba concha at the rear of the concha. In other examples, more than two legs or only a single leg may be used.

The outer leg 206A and the inner leg 206B have substantially equal lengths and are elliptical in shape. The outer leg 206A and the inner leg 206B taper in thickness from the body 204 to the tip 208. Therefore, as shown in FIG. 2A, a cross-section at 222A would result in larger, substantially elliptical shapes than a cross-section at 222B. FIG. 2D illustrates an example cross-section off the elliptical shapes 200D of the outer leg 206A and inner leg 206B.

The increased thickness of the legs 206A, 206B closer to the body 204 provides increased stiffness and stability of the positioning and retaining structure 206 closer to the body 204. The stability of the positioning and retaining structure is increased in at least two ways. First, tapered legs of the positioning and retaining structure help to stiffen the legs and make it more difficult to flex the legs into and out of the page (Z direction), when the ear tip is viewed from the front of back (e.g., FIG. 2A and FIG. 4). Additionally, tapered legs make it more difficult to press the legs towards each other and rotate away from the anti-helix in the opposite direction of the Y vector. These two motions are typically used to remove an ear tip from the wearer's ear. In an example, the X vector represents the constant force felt when the ear tip is inserted in a wearer's ear. Therefore, in aspects, stiffness is increased in the Z direction and along the Y vector and not as much along the X vector. According to aspects, and as shown in FIG. 2D, to achieve a higher stiffness in the Y and Z directions, the cross-section of each of the legs 206A and 206B are substantially elliptical in shape. A substantially elliptical shape as opposed to other shapes, such as a blended rectangle, creates a lean, simple design that allows more stiffness along the major axis of the ellipse with little or no change to the minor axis. According to aspects, a tapered outer leg 206A also helps to stiffen the positioning and retaining structure 206 in the Y and Z directions with minimal impact to the wearer's comfort along the X direction. In examples where there are more or fewer legs, each leg presented tapers in thickness from the body 204 to the tip 208 as described herein.

Aspects describe and illustrate a positioning and retaining structure having two legs; however, the disclosure is not limited to an ear tip having two legs. In an example, an ear tip includes a single leg extending from the body and configured to follow the curve of the anti-helix and/or the cymba concha at the rear of the concha. The single leg tapers in thickness from the body to the tip.

Generally, the substantially frusto-conical sealing structure 212 is placed in the wearer's ear and pushed gently inward and preferably rotated counter-clockwise. Pushing the body into the ear causes the outer leg 206A to seat in position underneath the anti-helix, and causes the narrow end of the sealing structure 212 to enter the ear canal by a small amount, depending on the dimensions and geometry of the entrance to the ear canal. The body 204 is then rotated clockwise until the body cannot be further rotated. One example of steps for placing an earpiece or ear tip in a wearer's ear are described in U.S. Pat. No. 8,737,669, entitled "Earpiece passive noise attenuating," which is incorporated by reference herein in its entirety.

According to aspects, the body 204 provides access to internal housing of the earbud. As illustrated in FIG. 3, in an example, a component 226 (which may be a housing of the earbud) includes a sensor lens 220 and an opening for a pressure equalization (PEQ) port 224, which vents from the front cavity of the acoustic driver to an environment external to the earbud. The sensor lens may be an infrared (IR) sensor. The IR sensor may be used to collect biologically relevant information of a user wearing the earpiece, or to detect whether the earbud is engaged with or near a wearer's ear. The PEQ port may be used, for example, in non-ANR earpieces, to relieve air pressure that could be built up within the ear canal and front cavity of the earbud, e.g., when the earbud is inserted into or removed from the ear, when a person wearing the earbud experiences shock or vibration, or when the earbud is struck or repositioned while being worn. FIG. 7 illustrates an example front chamber of an earbud having an opening 220A for a sensor lens and a PEQ port 224. FIG. 4 illustrates an opening 228 in ear tip for the component 226.

The locations of the sensor lens 220 and port 224 towards the back of the earpiece proximate to the concha, as illustrated in FIGS. 3-5 help to position components of the earpiece towards the wearer's concha to make the earpiece compact and protrude less from the wearer's ear.

FIG. 8 illustrates an ear tip formed using a triple durometer material. In some aspects, the body 204 includes an inner body 204A and an outer body 204B, 204C. The inner body 204A may be referred to as a core. The inner body 204A holds the earbud (not illustrated in FIG. 8) in the ear tip. According to aspects, the outer body 204B, 204C is formed over the inner body 204A. The method of forming the outer body using two materials molded over a first material that forms the inner core is referred to as 2-1 molding, because two different materials are molded over the single material of inner core at a same time. According to aspects, the tolerance of where the two materials, that are formed over the inner core, merge is anywhere between lines 802 and 804. In aspects, the two different materials molded over the inner core have different colors to form a multi-colored ear tip. In an aspect, the sealing structure 212 and the nozzle 210 (shown, for example, in FIG. 1) are formed from a first material. In one example, the sealing structure 212 and the nozzle 210 are formed from the first material and the positioning and retaining structure 206 is formed from a second material. In aspects, the two materials that are molded over the inner core have different colors and different hardness values.

The inner body 204A is formed using a more rigid material relative to the materials of the outer body 204B and 204C. The outer body is formed of material having two different durometers, both of which are more flexible than the material used to form the inner core.

In an example, the inner body 204A is made of a material having a first, hardness. The positioning and retaining structure (including outer leg 206A and inner leg 206B) and a portion of the outer body 204B proximate to the outer and inner legs are made of material having a second hardness. The frusto-conical sealing structure 212 and a portion of the outer body 204C proximate to the sealing structure are made of a material having a third hardness. The second hardness is softer and more flexible than the first hardness, yet harder than the third hardness. Accordingly, the positioning and retaining structure 206 of the outer body 204B are softer than the material of the inner body 204A and the material of the sealing structure 212 and the portion of the outer body 204C are the softest.

In an example, the inner body 204A is formed with a material having a durometer of approximately 70 Shore A, the positioning and retaining structure 206 and portion of the outer body 204B are formed with a material having a durometer of approximately 40 Shore A, and the sealing structure 212 and the portion of the outer body 204C are formed with a material having a durometer of approximately 20 Shore A. While the area of transition between the outer body 204B and the outer body 204C is shown as being approximately in the center of the body, in other examples, the area of transition could be in other locations along the length of the body.

In an example, the inner body 204A is formed with a material having a durometer of approximately 70 Shore A, the positioning and retaining structure 206 is formed with a material having a durometer of approximately 30 Shore A, and the sealing structure 212 is formed with a material having a durometer of approximately 10 Shore A.

Example materials and hardness values are provided for illustrative purposes only. According to aspects, different combination of materials and hardnesses are used for the three sections 204A, 204B, and 204C. In aspects, the three sections are made of made of the same materials and have a same or substantially similar hardness. While one example describes the positioning and retaining structure 206 being harder than the sealing structure 212, in an aspect, the positioning and retaining structure 206 and the sealing structure 212 have a similar or substantially similar hardness. In aspects, the three sections are made of the same material and have different hardness values. In aspects, the three sections are made of at least two materials.

In a non-illustrated example, a material having a first, more rigid durometer is used to form the inner body 204A. A material having a second durometer that is less rigid than the first durometer is used to form the outer body 204B, 204C. A material having a third durometer that is less rigid than the second durometer is used to form the sealing structure. In an aspect, the positioning and retaining structure is formed of a material having the same durometer as the outer body.

A harder inner core makes the ear tip more rigid and provides support for the earbud housing. The positioning and retaining structure being more flexible than the inner core and more rigid than the sealing structure helps increase a wearer's comfort and provides stability for positioning the ear tip in the wearer's ear. The sealing structure formed of the most flexible material provides comfort when interfacing and providing a gentle seal with the ear canal. While examples refer to the ear tip being formed of silicone, in some examples, other materials may be used, such as thermoplastic elastomer (TPE), polycarbonate, or nylon. In aspects, any combination of materials is used such that the inner body is harder than the outer body, retaining structure, and sealing structure.

In an aspect, the earpiece 200A is coated or selected portions of the earpiece are coated. The coating increases comfort and stability when positioned in-ear. In an aspect, the coating provides a smooth exterior finish that limits the amount of lint, dust, or particles that may adhere to the earpiece. The coating makes the earpiece easier to position by a wearer. In one example, the coating helps the earpiece move around slightly and find a stable position while a wearer is inserting the earpiece in-ear. In an example, any external portion of the earpiece is coated. In one specific example, the body 204 and the frusto-conical sealing structure 212 are coated and the positioning and retaining structure 206 is not coated. In another example, the entire exterior surface of the earpiece is coated.

The features illustrated in FIGS. 2A-10 may be combined in any manner that is technically feasible. As an example, the ear tip illustrated in FIG. 2A may include a sealing structure that has a substantially constant thickness as shown in FIG. 2C, a positioning and retaining structure that tapers in thickness from the body towards the tip, and a nozzle having a non-planar distal end.

The earpiece described herein includes a tip that provides orientation, stability, and good sealing to the entrance to the ear canal and to the ear structure outside the ear canal, without excessive radial pressure, and without inward clamping pressure provided by a source not included in the earpiece.

The earpiece described herein is applicable to a variety of devices, including audio headphones, hearing aids, hearing assistance headphones, noise-masking earbuds, ANR headphones, aviation headphones, and other devices that include a structure for interfacing with a wearer's ear.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. An ear tip for an in-ear earpiece, comprising:

an ellipsoid-shaped body shaped to fit in the lower concha of a wearer's ear;

a nozzle extending towards the ear canal of the wearer's ear, the nozzle including an acoustic passage to conduct sound waves to the ear canal of the wearer;

a substantially frusto-conical sealing structure extending from the nozzle, wherein a narrow end of the sealing structure is joined to the nozzle and a wide end of the sealing structure is larger than the average width of a human ear canal; and a retaining structure extending from the body towards the antihelix of the wearer's ear, wherein the retaining structure comprises a first leg that tapers in thickness from the body to a tip and a second leg having a first end attached to the first leg at an attachment end to form the tip and a second end attached to the body, wherein the second leg tapers in thickness from the body to the tip.

2. The ear tip of claim 1, wherein:

the body comprises an inner body and an outer body, and a material of the inner body has a first hardness, a material of the outer body, the first leg, and the second leg has a second hardness, and a material of the frusto-conical sealing structure has a third hardness, and the first hardness is greater than the second hardness, and the second hardness is greater than the third hardness.

3. The ear tip of claim 1, wherein the frusto-conical sealing structure comprises a substantially straight edge on the interior portion of the frusto-conical sealing structure proximate to the nozzle, and a curvature on the exterior portion of the frusto-conical sealing structure, wherein the exterior portion contacts flesh of the wearer's ear when the ear tip is positioned in the wearer's ear.

4. The ear tip of claim 1, wherein the body comprises an inner body and an outer body, and a material of the outer body is disposed over a material of the inner body.

5. The ear tip of claim 4, wherein: the material of the inner body has a first hardness, the material of the outer body has a second hardness, and a material of the frusto-conical sealing structure has a third hardness, wherein the first hardness is greater than the second hardness, and the second hardness is greater than the third hardness.

6. The ear tip of claim 5, wherein a material of the retaining structure has the second hardness.

7. The ear tip of claim 1, wherein the first leg and the second leg each have an elliptical cross-section.

8. The ear tip of claim 1, wherein the nozzle extends towards the ear canal at an upward angle relative to a horizontal centerline of the body.

9. The ear tip of claim 1, wherein the nozzle extends from the body towards the ear canal at an angle to fit into the ear canal.

10. The ear tip of claim 1, wherein the nozzle comprises a distal end, and at least a portion of the distal end of the nozzle comprises a non-planar surface.

11. The ear tip of claim 10, wherein the non-planar surface comprises a series of peaks and valleys.

12. The ear tip of claim 10, wherein the non-planar surface is closer to the inner ear of the wearer than the body of the ear tip when the ear tip is positioned in the wearer's ear.

13. The ear tip of claim 1, wherein the body includes a cut-out configured to house a pressure equalization (PEQ) port.

14. The ear tip of claim 1, wherein the frusto-conical sealing structure has a substantially constant thickness from the nozzle to the wide end of the sealing structure.

15. An ear tip for an in-ear earpiece, comprising:

a substantially ellipsoid-shaped body shaped to fit in the lower concha of a wearer's ear;

a nozzle extending towards the ear canal of the wearer's ear at an upward angle relative to a horizontal centerline of the body, the nozzle including an acoustic passage to conduct sound waves to the ear canal of the wearer;

a substantially frusto-conical sealing structure extending from the nozzle, wherein a narrow end of the sealing structure is joined to the nozzle and a wide end of the sealing structure is wider than the average width of a human ear canal; and a retaining structure extending from the body towards the antihelix of the wearer's ear, wherein the retaining structure comprises a first leg that tapers from the body to a tip and a second leg having a first end attached to the first leg at an attachment end to form the tip and a second end attached to the body, wherein the second leg tapers in thickness from the body to the tip, and wherein the first leg and the second leg are attached to the body above the horizontal center line of the body.

16. The ear tip of claim 15, wherein the length of the first leg is substantially equal to the length of the second leg.

17. The ear tip of claim 15, wherein an end of the nozzle located closest to the inner ear of the wearer when the ear tip is positioned in the wearer's ear comprises a non-planar surface.

18. The ear tip of claim 17, wherein the non-planar surface comprises a series of peaks having substantially equal heights and a series of valleys having substantially equal heights.

19. The ear tip of claim 15, wherein:

the body comprises an inner body and an outer body, and a material of the outer body is disposed over a material of the inner body, wherein the material of the inner body is harder than the material of the outer body.

20. The ear tip of claim 19, wherein the material of the outer body is harder than a material of the frusto-conical sealing structure.

21. The ear tip of claim 15, wherein the body includes a cut-out configured to house a pressure equalization (PEQ) port.

22. The ear tip of claim 15, wherein the frusto-conical sealing structure has a substantially constant thickness from the nozzle to the wide end of the sealing structure.

23. The ear tip of claim 15, wherein the first leg is curved to follow a curve of an anti-helix or cymba concha of the wearer's ear, and wherein the second leg is curved towards the tip.

24. The ear tip of claim 1, wherein the first leg and the second leg are attached to the body above the horizontal center line of the body.

25. The ear tip of claim 1, wherein the first leg and the second leg are attached to the body above a horizontal center line of the nozzle.

26. The ear tip of claim 1, wherein a thickness of the body is greater than a thickness of the retaining structure.

* * * * *